US009252512B2

(12) United States Patent
Debabrata

(10) Patent No.: US 9,252,512 B2
(45) Date of Patent: Feb. 2, 2016

(54) POWER CONNECTOR HAVING ENHANCED THERMAL CONDUCTION CHARACTERISTICS

(71) Applicant: Hamilton Sundstrand Corporation, Charlotte, NC (US)

(72) Inventor: Pal Debabrata, Hoffman Estates, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 92 days.

(21) Appl. No.: 14/162,975

(22) Filed: Jan. 24, 2014

(65) Prior Publication Data

US 2015/0050830 A1 Feb. 19, 2015

Related U.S. Application Data

(60) Provisional application No. 61/865,842, filed on Aug. 14, 2013.

(51) Int. Cl.

| | |
|---|---|
| ***H01R 13/00*** | (2006.01) |
| ***H01R 12/70*** | (2011.01) |
| *H01R 12/58* | (2011.01) |

(52) U.S. Cl.

CPC ..... *H01R 12/7088* (2013.01); *H01R 12/58* (2013.01)

(58) Field of Classification Search

CPC ..... H01L 23/4006; H01L 23/4093; H01L 2924/14; H01R 33/975; F21V 29/004; H05K 1/0206

USPC ..... 439/485–487; 361/704, 707, 710, 712, 361/718, 720

See application file for complete search history.

(56) References Cited

U.S. PATENT DOCUMENTS

| | | | | |
|---|---|---|---|---|
| 5,646,828 | A | 7/1997 | Degani et al. | |
| 6,299,492 | B1 * | 10/2001 | Pierini et al. | 439/884 |
| 6,733,324 | B1 | 5/2004 | Lecsek et al. | |
| 6,744,640 | B2 | 6/2004 | Reis et al. | |
| 6,837,744 | B2 * | 1/2005 | To et al. | 439/587 |
| 6,881,077 | B2 * | 4/2005 | Throum | 439/76.1 |
| 7,095,098 | B2 | 8/2006 | Gerbsch et al. | |
| 7,476,108 | B2 | 1/2009 | Swain et al. | |
| 7,833,023 | B2 * | 11/2010 | Di Stefano | 439/73 |
| 7,857,656 | B2 * | 12/2010 | Tai et al. | 439/485 |
| 8,139,364 | B2 * | 3/2012 | Wickett | 361/752 |
| 8,362,607 | B2 | 1/2013 | Scheid et al. | |
| 8,422,233 | B2 * | 4/2013 | Li et al. | 361/720 |
| 8,721,359 | B1 * | 5/2014 | Tate | 439/487 |
| 2003/0139071 | A1 | 7/2003 | Li et al. | |
| 2013/0109224 | A1 | 5/2013 | Chin et al. | |

FOREIGN PATENT DOCUMENTS

WO WO-2007109368 A2 9/2007

* cited by examiner

*Primary Examiner* — Thanh Tam Le

(74) *Attorney, Agent, or Firm* — Locke Lord LLP; Scott D. Wofsy; Joshua L. Jones

(57) ABSTRACT

A power connector assembly is disclosed that includes a connector shell formed from a heat conducting material, a plurality of connector pins arranged in the connector shell, and a heat conduction element arranged in the connector shell in thermal contact with the plurality of connector pins for conducting heat dissipated by the connector pins to the connector shell.

15 Claims, 4 Drawing Sheets

POWER CONNECTOR HAVING ENHANCED THERMAL CONDUCTION CHARACTERISTICS

CROSS-REFERENCE TO RELATED APPLICATION

This application claims the benefit of priority to U.S. Provisional Patent Application No. 61/865,842 filed Aug. 14, 2013 which is incorporated by reference herein in its entirety.

BACKGROUND OF THE INVENTION

1. Field of the Invention

The subject invention relates to a power connector, and more particularly, to a power connector having enhanced thermal properties for carrying high current to a printed wiring board within the chassis of an electronic device.

2. Background of the Related Art

Power connectors used in electronic devices, including power electronic convertors and motor controllers, carry currents as high as 20 A-40 A or more to a printed wiring boards (PWB) housed within the device. Typically, connector pins soldered to plated through-holes on a PWB conduct power from the power connector to the PWB. The plated through-holes are connected to internal layers of the PWB that carry current and also help to dissipate heat generated by the connector pins.

Heat conducted from the connector pins of a power connector tends to raises the temperature of the PWB. More specifically, during operation, the portion of the PWB near the plated through holes tend to become overheated. These elevated operating temperatures can result in increased fatigue at the plated through-holes. This causes reduced life and reliability for the entire PWB assembly.

It would be beneficial to provide a power connector system for carrying high current to a printed wiring board of an electronic device that has improved heat transfer characteristics to protect the printed wiring board from thermal fatigue damage.

SUMMARY OF THE INVENTION

This subject invention is directed to a new and useful power connector assembly that includes a connector shell formed from a heat conducting material, a plurality of connector pins arranged within the connector shell, and a heat conduction element arranged in the connector shell in thermal contact with the plurality of connector pins for conducting heat dissipated by the connector pins to the connector shell.

More particularly, the subject invention is directed to a power connector assembly that includes a connector shell formed from a heat conducting material such as, for example, copper, aluminum or Kovar. The connector shell is configured to extend between a chassis wall of an electronic device and a printed wiring board mounted within the chassis of the device. For example, the electronic device can be in the form of a power electronic convertor or a motor controller, which are devices that typically carry high current loads (e.g., 26 A).

A plurality of connector pins are arranged within the connector shell and each connector pin has a socket associated therewith for receiving a corresponding feeder pin. The connector pins extend between the chassis wall of the electronic device and the printed wiring board within the electronic device.

A heat conduction element is disposed within the connector shell adjacent a facing surface of the printed wiring board.

The heat conduction element has a plurality of through-holes formed therein for accommodating the plurality of connector pins. In use, heat dissipated from the connector pins to the heat conduction element is conducted to the chassis wall of the electronic device by way of the connector shell to protect the printed wiring board housed within the electronic device from thermal fatigue damage.

Preferably, a first portion of the connector shell is in thermal contact with the chassis wall of the electronic device, and a second portion of the connector shell is in thermal contact with the heat conduction element. More particularly, a recess is formed in a lower surface of the second portion of the connector shell for accommodating the heat conduction element.

It is envisioned that the heat conduction element associated with the connector shell may be constructed from a conformable thermally conductive pad, such as, for example, a pad made from a fiberglass reinforced polymer material having a matrix of highly thermal conductive particles embedded therein. Alternatively, the thermally conductive pad may be made from laminated layers of an anodized aluminum material, or from a similar material.

The printed wiring board includes a plurality of plated through holes for accommodating the plurality of connector pins. An inner peripheral surface of each of the through-holes in the printed wiring board is plated with a conductive material. The plated surfaces of the through-holes in the printed wiring board are in turn connected to embedded conductive layers of the printed wiring board.

The printed wiring board is preferably mounted to the chassis wall by a plurality of mounting bosses forming a spatial gap between the chassis wall and the printed wiring board. Preferably, the chassis wall is connected to a heat sink.

These and other features of the power connector assembly of the subject invention will become more readily apparent from the following detailed description taken in conjunction with the appended drawings.

BRIEF DESCRIPTION OF THE DRAWINGS

So that those having ordinary skill in the art to which the present invention pertains will more readily understand how to make and use the power connector assembly disclosed herein, aspects thereof will be described in detail hereinbelow with reference to the drawings, wherein.

DETAILED DESCRIPTION OF THE PREFERRED EMBODIMENTS

Figure 1:
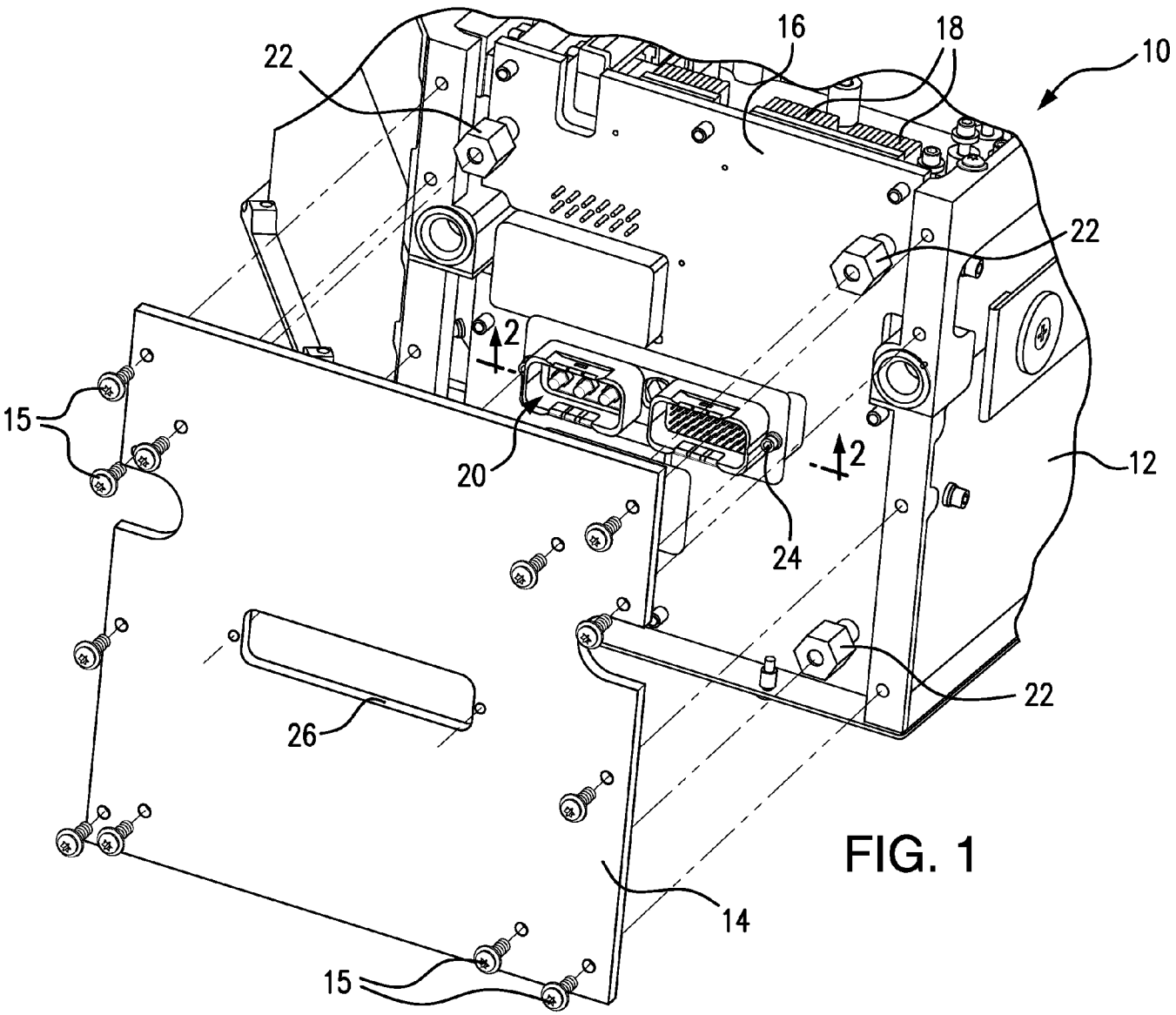
FIG. 1 is a partial perspective view of the chassis of an electronic device that includes the power connector of the subject invention, with the end wall of the chassis removed to reveal the printed wiring board housed therein.

Referring now to the drawings wherein like reference numerals identify similar structural features or aspects of the subject invention, there is illustrated in FIG. 1 an electronic device 10 that includes a power connector assembly constructed in accordance with a preferred embodiment of the subject invention and designated generally by reference numeral 20. Power connector assembly 20 has enhanced thermal conduction characteristics as compared to prior art power connectors, as will be discussed in greater detail hereinbelow.

Those skilled in the art will readily appreciate that the power connector of the subject invention is not limited to being used with any particular type of electronic device. Examples of electronic devices with which the power connector of the subject invention could be employed include power electronics convertors or motor controllers.

The subject invention is also not limited to an electronic device that is intended for any particular application or operating environment. However, it should be appreciated that the electronic device of the subject invention could be particularly useful in aerospace applications where it is necessary for a power connector to carry high currents (e.g., 26 A) to a printed wiring board (PWB). Those skilled in the art will readily appreciate that the chassis 12 may be connected to a heat sink (not shown) or located in or near the path of a cooling air flow, supplied by a fan or a similar mechanical cooling device (not shown).

Referring now to FIG. 1, the electronic device 10 includes an outer chassis 12 having a removable front wall 14. The front wall 14 is secured to the chassis 12 by a plurality of threaded fasteners 15, as shown. The chassis 12 of electronic device 10 houses, among other things, a PWB assembly 16 having associated therewith a plurality of power electronic components 18, such as, for example, power electronic semiconductor devices and bulk capacitors.

A plurality of post 22 form a spatial gap between the chassis wall 12 and the PWB assembly 16. The posts 22 provide a direct path for heat conduction between the PWB assembly 16 and the chassis wall 12, helping to reduce thermal fatigue damage to the PWB assembly 16.

The power connector 20 of the subject invention, which is also designed to reduce thermal fatigue damage, is mounted to the PWB assembly 16 by fasteners 24. Direct access to the power connector 20 is obtained through a window or opening 26 provided in the front wall 14 of the chassis 12.

Figure 2:
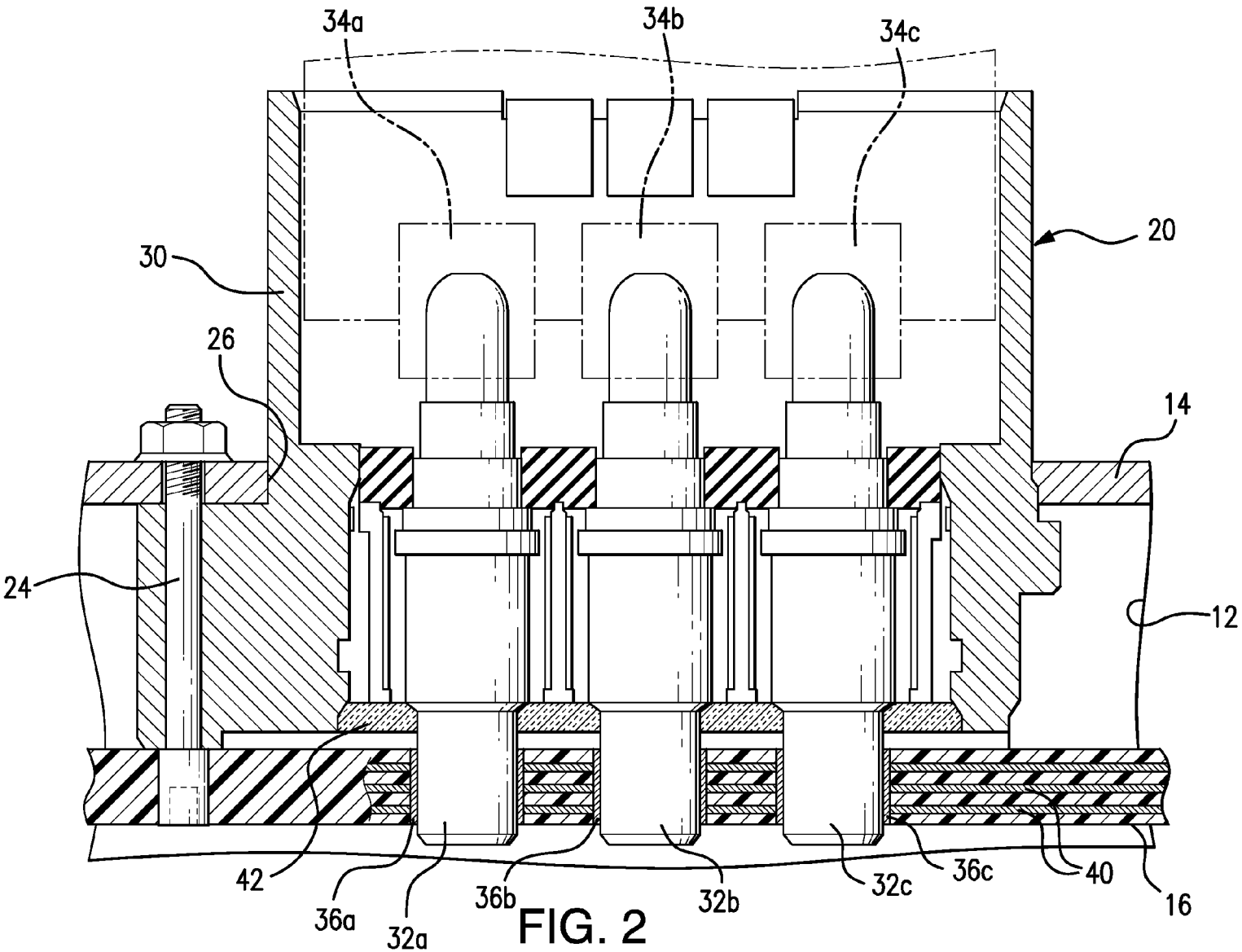
FIG. 2 is a cross-sectional view of the power connector of the subject invention taken along line 2-2 of FIG. 1, but with the end wall of the chassis in place.

Referring to FIG. 2, the power connector 20 includes a connector shell or body 30 advantageously formed from a heat conducting material, such as, for example, Copper, Aluminum, Kovar® or a similar heat conducting material. Kovar, which is manufactured and sold by Carpenter Technology Corporation is a Ni—Co—FE alloy, is particularly well suited for this application, because of its thermal expansion characteristics, which allow for direct mechanical connections over a range of temperatures.

The connector shell 30 is configured to extend between the chassis wall 12 of electronic device 10 and the PWB assembly 16. More particularly, the upper portion of the connector shell 30 of power connector 20 extends through the access opening 26 formed in the front wall of 14 of chassis 12 and it is in contact with the inner periphery of the access opening 26, as best seen in FIG. 2. Consequently, the connector shell 30 and the chassis wall 14 are in thermal communication with each other and heat can be readily conducted therebetween.

A plurality of connector pins 32*a*-32*c* are arranged within the connector shell 30. Each connector pin 32*a*-32*c* includes a socket 34*a*-34*c* for receiving a corresponding feeder pin (not shown). The connector pins 32*a*-32*c* extend between the chassis wall 12 of the electronic device and the PWB 16.

The PWB assembly 16 includes a plurality of through-holes 36*a*-36*c*. An inner peripheral surface of each of the through-holes 36*a*-36*c* is plated with a conductive material, such as copper or the like. The connector pins 32*a*-32*c* are respectively soldered to the plated through-holes 36*a*-36*c*.

The plated surfaces of the through-holes 36*a*-36*c* in the PWB assembly 16 are in turn connected to embedded conductive layers 40 of the PWB assembly 16. The conductive layers are formed from copper or a similar material and carry current to the various power electronic devices and components operatively associated with the PWB assembly 16.

With continuing reference to FIG. 2, a heat conduction element 42 is disposed within the connector shell 30 adjacent a facing surface of the PWB assembly 16. It is envisioned that the heat conduction element 42 may be constructed from a conformable thermally conductive pad, such as, for example, a pad made from a fiberglass reinforced polymer material having a matrix of highly thermal conductive particles embedded therein. A particularly useful material for this application is Bergquist 5000S35, which is manufactured by the Burquist Company of Chanhassen, Minn.

Alternatively, the heat conduction element 42 can be formed from laminated layers of an anodized aluminum material, or a similar laminated material. A particularly useful arrangement of this type would include laminated Ano-Fol layers. Ano-Fol is a material that is manufactured by the Ulrich Aluminum Company Ltd., of New Zealand.

Figure 3:
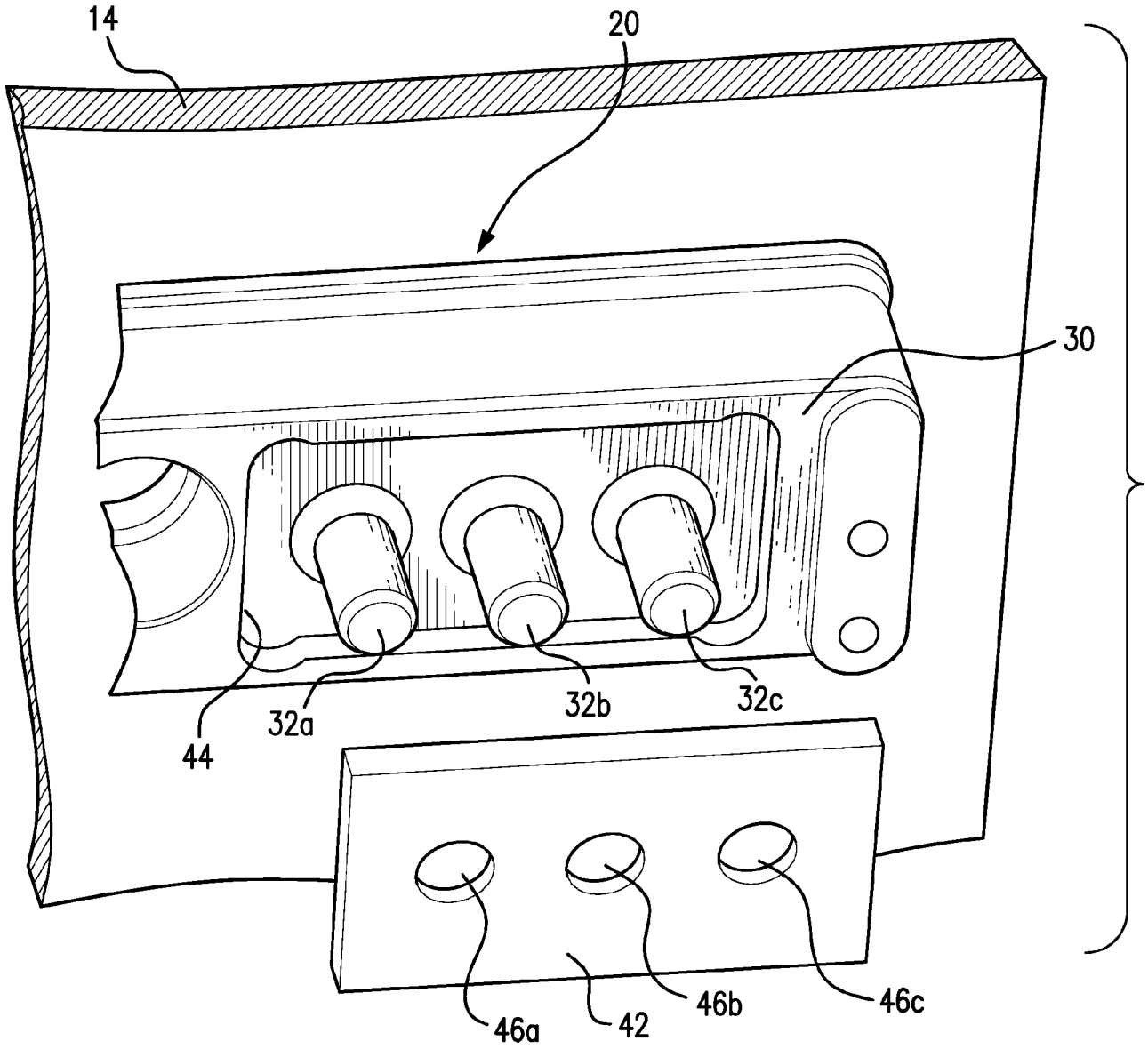
FIG. 3 is a localized perspective view of the power connector of the subject invention separate from the printed wiring board and showing the heat conduction element separated from the power connector shell.

As best seen in FIG. 3, a recess 44 is formed in the bottom surface of the connector shell 30 for accommodating the heat conduction element 42. The heat conduction element 42 has a plurality of through-holes 46*a*-46*c* formed therein for accommodating the plurality of connector pins 32*a*-32*c*. The connector pins 32*a*-32*c* are in thermal contact with the through-holes 46*a*-46*c*, respectively. Consequently, heat can be readily conducted between the connector pins 32*a*-32*c* and the heat conduction element 42.

Figure 4:
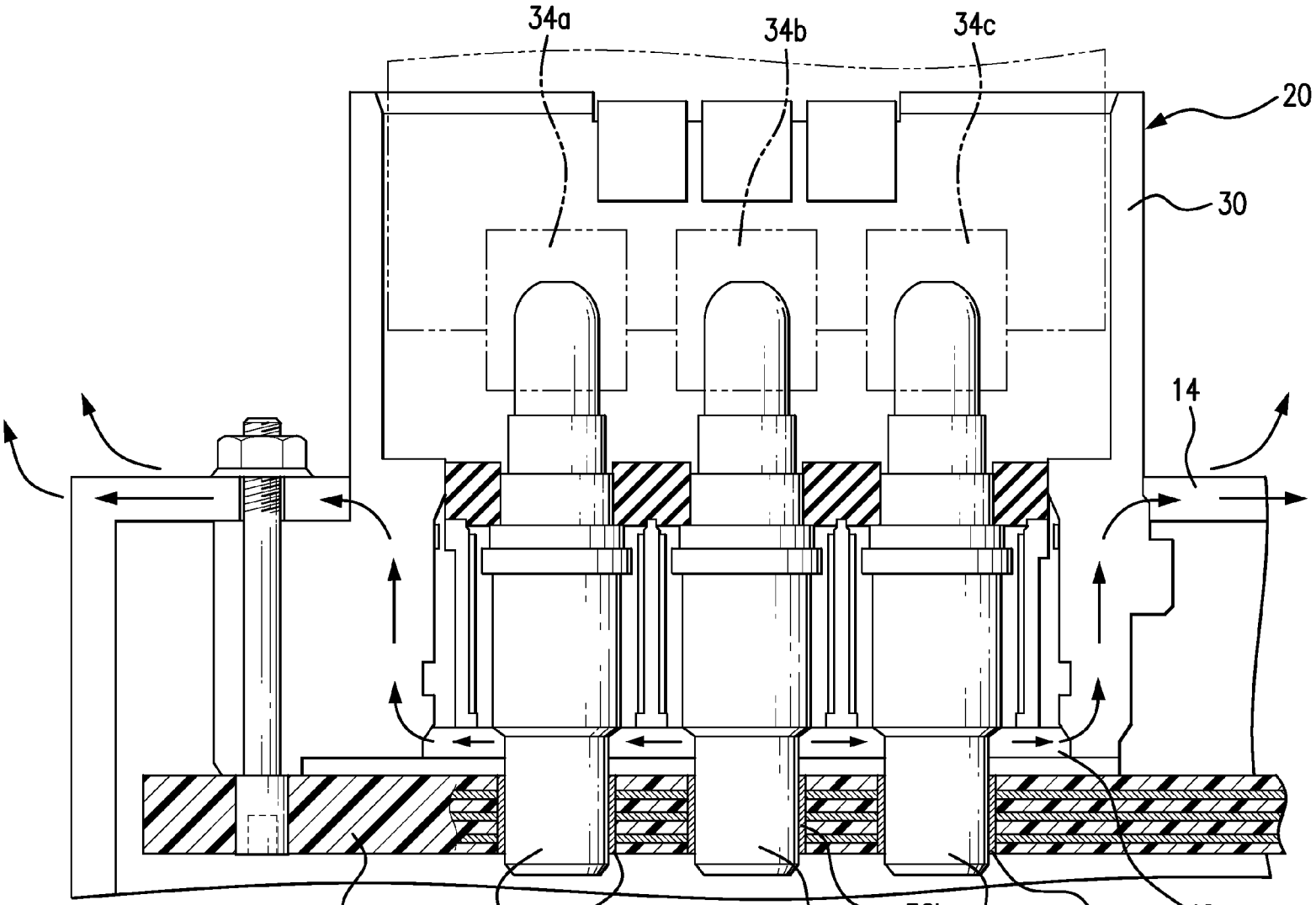
FIG. 4 is a cross-sectional view as in FIG. 2, but showing the directional flow of heat dissipated from the connector pins to the power connector shell through the heat conduction element to protect the printed wiring board from thermal fatigue damage.

As illustrated in FIG. 4, during use, heat dissipated from the connector pins 32*a*-32*c* to the heat conduction element 42 within recess 44 is conducted to the chassis wall 14 of the electronic device 10 by way of the connector shell 30 of power connector 20. This effectively and advantageously protects the PWB assembly 16 from thermal fatigue damage.

Indeed, it has been shown through experimental fatigue analysis focused on the through-holes 36*a*-36*c* of the PWB assembly 16, that thermal fatigue life is increased by a factor of about 2.3 when the heat conduction enhancement of the subject invention is employed in a power connector assembly.

Those skilled in the art will readily appreciate that because of the power connector assembly of the subject invention, a high current carrying PWB assembly with plated through-holes and current carrying power pins can be cooled more efficiently, in a localized manner. Consequently, the thermal fatigue life of the plated through-holes in the PWB assembly can be significantly increased.

Although the subject invention has been described with respect to preferred embodiments, those skilled in the art will readily appreciate that changes and modifications may be made thereto without departing from the spirit and scope of the subject invention as defined by the appended claims

What is claimed is:

1. A power connector assembly comprising:

a) a connector shell formed from a heat conducting material;

b) a plurality of connector pins arranged in the connector shell; and c) a heat conduction element arranged in the connector shell in thermal contact with the plurality of connector pins for conducting heat dissipated by the connector pins to the connector shell, wherein the connector shell is configured to extend between a chassis wall of an electronic device and a printed wiring board mounted within a chassis of the device.

2. A power connector assembly as recited in claim 1, wherein the plurality of connector pins extend between the chassis wall and the printed wiring board, and each connector pin includes a socket for receiving a corresponding feeder pin.

3. A power connector assembly as recited in claim 1, wherein the heat conduction element is located adjacent to a facing surface of the printed wiring board.

4. A power connector assembly as recited in claim 1, wherein a first portion of the connector shell is in thermal contact with the chassis wall.

5. A power connector assembly as recited in claim 4, wherein a second portion of the connector shell is in thermal contact with the heat conduction element.

6. A power connector assembly as recited in claim 5, wherein the second portion of the connector shell is formed with a recess for accommodating the heat conduction element.

7. A power connector assembly as recited in claim 1, wherein the printed wiring board includes a plurality of through-holes for accommodating the plurality of connector pins, and wherein an inner peripheral surface of each of the through-holes in the printed wiring board is plated with a conductive material.

8. A power connector assembly as recited in claim 7, wherein the plated surfaces of the through-holes in the printed wiring board are connected to embedded conductive layers of the printed wiring board.

9. A power connector assembly as recited in claim 1, wherein the printed wiring board is mounted to the chassis wall by a plurality of mounting bosses forming a spatial gap between the chassis wall and the printed wiring board.

10. A power connector assembly comprising:

a) a connector shell formed from a heat conducting material and configured to extend between a chassis wall of an electronic device and a printed wiring board mounted within the chassis of the device;

b) a plurality of connector pins arranged within the connector shell and extending between the chassis wall and the printed wiring board; and c) a heat conduction element disposed within a recess formed in the connector shell adjacent a facing surface of the printed wiring board, the heat conduction element having a plurality of through-holes formed therein for respectively accommodating the plurality of connector pins, wherein heat dissipated from the connector pins to the heat conduction element is conducted to the chassis wall by way of the connector shell to protect the printed wiring board from thermal fatigue damage.

11. A power connector assembly as recited in claim 10, wherein a first portion of the connector shell is in thermal contact with the chassis wall, and a second portion of the connector shell is in thermal contact with the heat conduction element.

12. A power connector assembly as recited in claim 10, wherein the heat conduction element is constructed from a thermally conductive pad.

13. A power connector assembly as recited in claim 10, wherein the heat conduction element in constructed from laminated layers of an anodized aluminum material.

14. A power connector assembly as recited in claim 10, wherein the printed wiring board includes a plurality of through-holes for accommodating the plurality of connector pins, and wherein an inner peripheral surface of each of the through-holes in the printed wiring board is plated with a conductive material.

15. A power connector assembly as recited in claim 10, wherein the printed wiring board is mounted to the chassis wall by a plurality of mounting bosses forming a spatial gap between the chassis wall and the printed wiring board, and wherein the chassis wall is connected to a heat sink.

* * * * *

UNITED STATES PATENT AND TRADEMARK OFFICE

CERTIFICATE OF CORRECTION

PATENT NO. : 9,252,512 B2
APPLICATION NO. : 14/162975
DATED : February 2, 2016
INVENTOR(S) : Debabrata Pal It is certified that error appears in the above-identified patent and that said Letters Patent is hereby corrected as shown below:

On the title page, item (72), Inventor should be listed as -- Debabrata Pal --.

Signed and Sealed this
Thirty-first Day of May, 2016

Michelle K. Lee

Michelle K. Lee
*Director of the United States Patent and Trademark Office*